US006276279B1

(12) United States Patent
Stephenson

(10) Patent No.: US 6,276,279 B1
(45) Date of Patent: Aug. 21, 2001

(54) TOY VEHICLE TRACK BOARD

(76) Inventor: William Monroe Stephenson, 5584 Belaire, New Orleans, LA (US) 70130

( * ) Notice: Subject to any disclaimer, the term of this patent is extended or adjusted under 35 U.S.C. 154(b) by 0 days.

(21) Appl. No.: 08/756,046

(22) Filed: Nov. 26, 1996

(51) Int. Cl.[7] ..... A63G 1/00

(52) U.S. Cl. ..... 104/53; 104/164; 104/79; 238/10 F

(58) Field of Search ..... 104/53, 55, 63, 104/67, 79, 164; 238/10 R, 10 A, 10 C, 10 F; 446/3, 168, 446, 396, 433, 489, 170, 174, 169; 273/109–116

(56) References Cited

U.S. PATENT DOCUMENTS

| | | | | |
|---|---|---|---|---|
| 620,445 | * | 2/1899 | Griesemer | 273/115 |
| 1,040,058 | * | 10/1912 | Tomlin | 273/110 |
| 1,215,033 | * | 2/1917 | King | 273/110 |
| 1,474,961 | * | 11/1923 | Foster | 273/110 |
| 1,502,365 | * | 7/1924 | Wilson | 273/110 |
| 1,982,633 | * | 12/1934 | Brown | 446/168 |
| 2,767,986 | * | 10/1956 | Newberry | 273/110 |
| 2,784,527 | * | 3/1957 | Sarff | 273/109 |
| 3,011,787 | * | 12/1961 | Modica et al. | 446/3 |
| 4,140,276 | | 2/1979 | Halford . | |
| 4,217,727 | | 8/1980 | Fetty et al. . | |
| 4,221,076 | | 9/1980 | Ozawa . | |
| 4,221,077 | | 9/1980 | von Winckelmann . | |
| 4,513,966 | * | 4/1985 | Mucaro et al. | 238/10 A |
| 4,673,182 | * | 6/1987 | Bowen | 104/53 |
| 4,697,812 | | 10/1987 | Rudell et al. . | |
| 4,795,154 | | 1/1989 | Lahr . | |
| 4,854,909 | | 8/1989 | Ishimoto . | |
| 4,878,876 | | 11/1989 | Ishimoto . | |
| 4,889,513 | | 12/1989 | Paddock . | |
| 4,895,542 | | 1/1990 | de Blanitza . | |
| 4,919,052 | | 4/1990 | Yoneda et al. . | |
| 4,940,443 | | 7/1990 | Hesse . | |
| 4,941,611 | * | 7/1990 | Arsenault | 238/10 A |
| 5,038,685 | | 8/1991 | Yoneda et al. . | |
| 5,203,733 | | 4/1993 | Patch et al. . | |
| 5,205,554 | | 4/1993 | Copson . | |

FOREIGN PATENT DOCUMENTS

| | | | | |
|---|---|---|---|---|
| 678294 | * | 9/1952 | (GB) | 446/446 |

* cited by examiner

*Primary Examiner*—Mark T. Le
(74) *Attorney, Agent, or Firm*—Thomas R. Vigil

(57) ABSTRACT

The toy vehicle track board has a lateral extent which can be square, oval or circular, with a lateral extent or diameter of 15" to 60", one preferred diameter being 30", a thickness of ⅛" to ¾", one preferred thickness being 5/16" and at least one track in the board extending at least partially around the board and having a depth between ⅙" and ½", one preferred depth being 3/16".

15 Claims, 2 Drawing Sheets

TOY VEHICLE TRACK BOARD

BACKGROUND OF THE INVENTION

1. Field of the Invention.

The present invention relates to a toy vehicle track board for young children primarily between 1 and 7 years old. More specifically, the present invention relates to a track board having a thickness of ⅛" to 5/16" and a radial or lateral extent of 15" to 60" with a track in the board having a depth of 1/16" to ½". In one preferred embodiment of the toy vehicle track board, the board is circular, has a diameter of 30 inches, a thickness of 5/16" and at least a primary, partially circular track having a depth of 3/16". If desired one or more additional tracks, such as an S-shaped track, is/are formed in the board and connects with the primary circular track.

2. Description of the Related Art Including Information Disclosed Under 37 CFR §§ 1.97–1.99.

Heretofore, toy cars have been manufactured and sold by a number of companies for display or as toys to be played with by young children. One well known toy car is sold under the trademark "MATCHBOX".

Young children find miniature cars attractive toys for rolling on a flat surface such as a tabletop, end table, desktop or floor. Also, young children have found much pleasure in moving the toy car on various types of tracks and for older children, a number of electrically operated tracks have been proposed.

Examples of two toy cars are disclosed in the following U.S. patents.

| U.S. Pat. No. | Patentee |
|---|---|
| 4,221,077 | Von Winkelmann |
| 4,895,542 | DeBlanitza |

Over the years, a variety of different types of tracks have been proposed for use by children and adults for playing with a toy car, automobile or vehicle. Often the tracks would be electrified and often the tracks were designed for use with mechanically or electrically operated toy vehicles and even RF operated toy vehicles. Some examples of previously proposed tracks for toy vehicles are disclosed in the following U.S. patents.

| U.S. Pat. No. | Patentee |
|---|---|
| 4,140,276 | Halford |
| 4,217,727 | Fetty et al. |
| 4,221,076 | Ozawa |
| 4,697,812 | Rudell et al. |
| 4,795,154 | Lahr |
| 4,854,909 | Ishimoto |
| 4,878,876 | Ishimoto |
| 4,889,513 | Paddock |
| 4,919,052 | Yoneda et al. |
| 4,940,443 | Hesse |
| 5,038,685 | Yoneda et al. |
| 5,203,733 | Patch et al. |
| 5,205,554 | Copson |

The previously proposed tracks for toy vehicles have been directed primarily to older children and were often provided with intricate paths, ramps, car launchers, and the like. Such tracks were too complicated for younger children.

As will be described hereinafter in greater detail, the toy vehicle track board of the present invention is designed for use by young children, typically one-and-a-half to six and-a-half years old, such as a two year old.

SUMMARY OF THE INVENTION

According to the present invention, there is provided a toy vehicle track board which can be of any desired shape, e.g., square, oval or circular, with a lateral extent, width or diameter of 15" to 60", one preferred diameter being 30", a thickness of ⅛" to ¾", one preferred thickness being 5/16", and at least one track in the board having a depth between 1/16" and ½", one preferred depth being 3/16".

The width of the track is between ½" and 3" and preferably 1.25". The width, of course, will depend upon the size of the toy car used with the track board.

The toy vehicle track board of the present invention has a number of advantages which are as follows:

1. It keeps the child's attention for hours at a time.
2. It is not frustrating for the child to use the track board.
3. It centralizes the child's play with cars to the track and keeps them off furniture, bookshelves, tables, etc.
4. It provides a stable base that can be used on a carpet, a floor, a footstool or coffee table.
5. The child can use the board with multiple cars at one time.
6. Since readily available model toy cars such as MATCHBOX® cars can be used with the track board, there are no batteries to wear out and no electric cords are involved.
7. The track board can be easily stored and unstored, ready for use without having to be assembled or unassembled.
8. If desired, track board can be enhanced with model garages, houses, hills, electrically lighted houses, miniature telephone polls or power lines and a horn or siren emitting device for actuation by the child.

DESCRIPTION OF THE PREFERRED EMBODIMENT(S)

Figure 1:
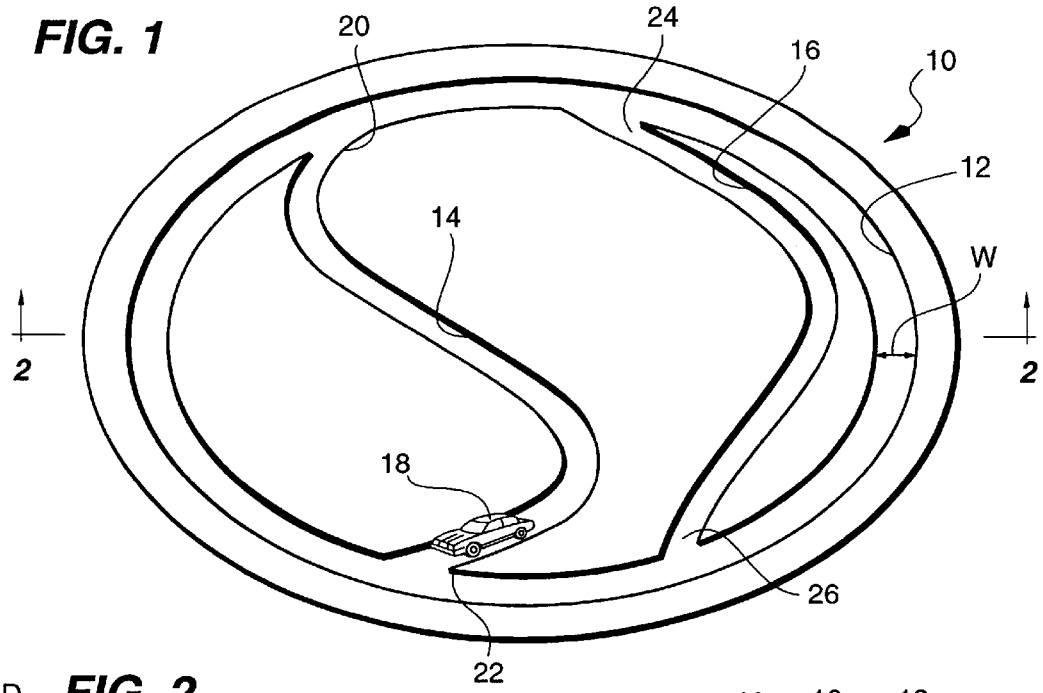
FIG. 1 is a top plan view of an oval shaped toy vehicle track board constructed in accordance with the teachings of the present invention and shows a perspective view of a toy car in a track on the board.

Referring now to FIG. 1 in greater detail, there is illustrated therein a top plan view of a toy vehicle track board 10 constructed according to the teachings of the present invention. As shown, the track board 10 is oval, oblong or elliptical in shape and can have a short extent of 20" and a long extent of 40".

Figure 3:
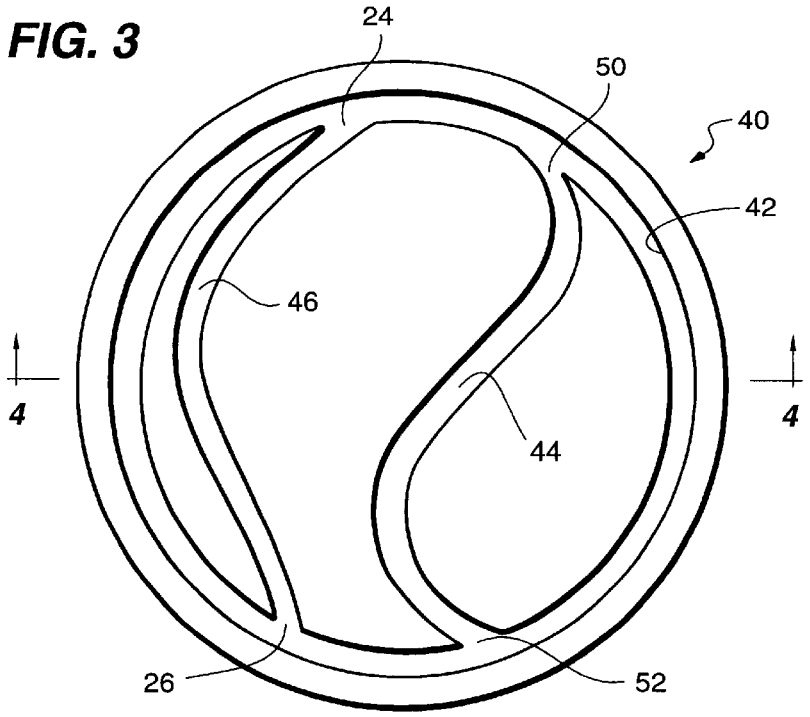
FIG. 3 is a top plan view of a circular shaped toy vehicle track board constructed in accordance with the teachings of the present invention.
Figure 4:
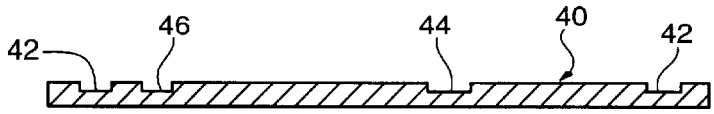
FIG. 4 is a cross-sectional view of the board shown in FIG. 3 and is taken along line 4—4 of FIG. 1.

It will be understood that the lateral extent of the track board 10 can vary between 15" and 16" and can be of various shapes such as square, rectangular or circular as shown in FIG. 3.

In the embodiment of the track board 10 shown in FIG. 1, the board is oval in shape and has a continuous, outer or margin located, oval track 12. The track 12 has a width W between ½" and 3" and depth D (FIG. 2) between 1/16" and ½".

Figure 2:
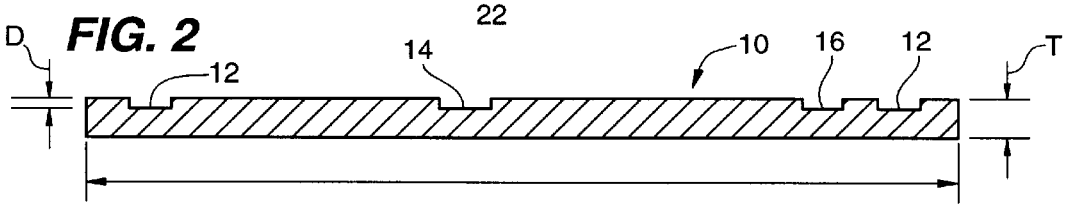
FIG. 2 is a cross-sectional view of the board shown in FIG. 1 and is taken along line 2—2 of FIG. 1.

Referring to FIG. 2, the thickness T or height of the board can be between ⅛" and ¾".

In one preferred embodiment of the track board 10, the depth D was 3/16", the width W was 1.25" and the thickness T or height was 5/16".

Referring again to FIG. 1, in addition to the track 12 two auxiliary tracks 14 and 16 are provided which intersect and connect with the oval track 12. The track 14 is shown with a toy car 18 therein and has a generally S-shape which connects with the oval track 12 at an entrance or exit end 20 on one side of the track board 10 and at an exit or entrance end 22 with the oval track 12 on the other side of the track board 10.

The track 16 is a generally curved or a "boomerang" shaped track which extends generally parallel with a portion of the continuous track 12 and which has an entrance or exit end 24 connecting with the oval track 12 at the one side of the track board 10 and an exit or entrance end 26 connecting with the track 12 on the other side of the track board 10.

Referring now to FIG. 3, there is illustrated therein a circular track board 40 which has a continuous, outer or margin located, circular track 42 an S-shaped track 44 and a curved or "boomerang" shaped track 46. The tracks 42, 44 and 46 have the same dimensions as the tracks 12, 14 and 16 of the track board 10, as described above in connection with the description of FIGS. 1 and 2. The track 44 has an entrance or exit end 50 and an exit or entrance end 52 both of which connect with the circular track 42.

The track 46 has an entrance or exit end 24 and an exit or entrance end 26, both of which connect with the circular track 42.

The diameter of the track board 40 can be between 15" and 60" and in one preferred embodiment is 30". The thickness of the track board 40 is between ⅛" and ¾" and in one preferred embodiment is 5/16".

The track board can be made of any suitable material such as paperboard, wood, plastic or even metal. Preferably, the track board will be made of molded plastic.

Figure 5:
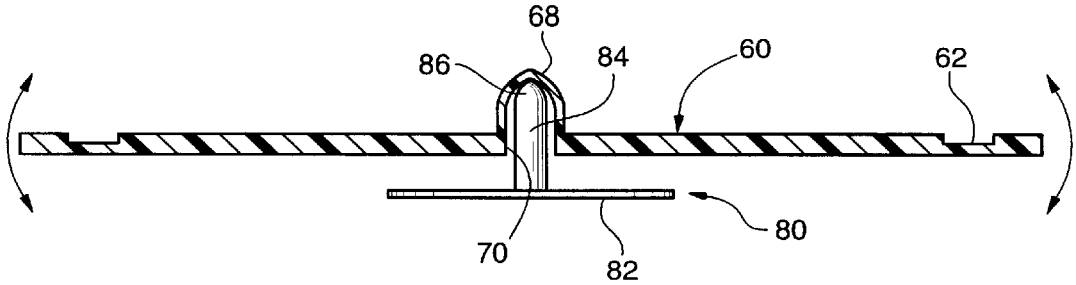
FIG. 5 is a cross-sectional view of a modified circular toy vehicle track board having a cavity on the underside thereof for positioning the track board on a support post whereby the track board can be tilted to cause the toy vehicle to move in the track.

In FIG. 5 there is illustrated a cross section of a modified track board 60. The track board 60 is shown with one circular track 62, although additional tracks can be provided similar to the tracks 44 and 46 in the track board 40.

The track board 60 is provided with a centrally disposed dome 68 on the top side of the board 60 and a cavity 70 on the underside of the board 60 extending upwardly into the dome 68. The board 60 is adapted to be used with a base support 80 comprising a base plate 82 mounting a post 84 having a dome or semi-sphere 86 at the upper end thereof.

The cavity 70 is bullet shaped having a semi-sphere at the upper end thereof or a pointed bullet shape. The post 84 has a smaller diameter than the diameter of the cavity 70 and has a dome 86 which mates or cooperates with the upper end of the cavity 70 and has the shape of a semi-sphere or a pointed bullet shape.

The base 82 can be cylindrical, square or rectangular and in one preferred embodiment is cylindrical. The post 84 has a height of 1" to 10" and in one preferred embodiment is approximately 7", e.g. 6.5". The diameter of the semi-sphere is 1" to 5" and preferably 3". One preferred height of the post is 3.5" plus 3" of the semi-sphere for a total height of 6.5".

It will be understood that the extent or diameter of the base 82 is greater than the diameter of the semi-sphere so that when the track board 60 is tilted, the track board 60 will, nonetheless, be stable.

By facilitating tilting of the board 60 with the base support 80, a young child can cause, to his delight, a toy vehicle to travel in the track as he tilts the track board 60 about the base support 80.

It is to be noted that various track arrangements can be provided such as one to five additional tracks arranged generally parallel to the principal track. In the track boards 10 and 40 shown in FIGS. 1 and 3, the length of the track 16 or 46 can be between 12" and 40" and in one preferred embodiment it is 20".

One to three S-shaped tracks can be provided with one S-shaped track being preferred.

One preferred track arrangement is one border track, oval track 12 or circular track 42, one generally parallel or "boomerang" shaped track 16 or 46 and one S-shaped track 14 or 44.

As is the case with model railroad layouts, the track board 10, 40 or 60 of the present invention can be as simple as described above or as complicated as desired with model garages, model houses, miniature telephone lines, miniature power lines and/or hills provided on the board 10,40 or 60.

From the foregoing description, it will be apparent that the track board 10, 40 or 60 of the present invention has a number of advantages, some of which have been described above and others of which are inherent in the invention. Also it will be understood that modifications can be made to the track board 10, 40 or 60 described above without departing from the teachings of the present invention. Accordingly, the scope of the invention is only to be limited as necessitated by the accompanying claims.

I claim:

1. In a model vehicle entertainment system for entertaining children, comprising a pre-existing non-powered model vehicle, the improvement residing in:

a track board having a uniform thickness, top and bottom surfaces, and at least an endless-loop track, said track being an endless guide groove having a uniform width, said guide groove having guide walls extending from the top surface towards the bottom surface of the track board, the track board having a greatest lateral extension of no more than 60 inches and said uniform thickness being no more than ¾ of an inch, the width of the guide groove and the width of the pre-existing model vehicle being of substantially the same dimension, wherein, the track board and the model vehicle are arranged for selective play operations including (1) moving the vehicle on the track board or (2) varying the inclination of the track board such that the vehicle is moved along the track by the force of gravity.

2. A track board system for entertaining children, comprising:

a pre-existing non-powered model automobile, a track board having a uniform thickness, top and bottom surfaces, and at least an endless-loop track, said track being an endless guide groove having a uniform width, said guide groove having guide walls extending from the top surface towards the bottom surface of the track board, the track board having a greatest lateral extension of no more than 60 inches and said uniform thickness being no more than ¾ of an inch, the width of the guide groove and the width of the pre-existing model automobile being of substantially the same dimension, wherein, the track board and the automobile are arranged for selective play operations including (1) moving the automobile on the track board or (2) varying the inclination of the track board such that the automobile is moved along the track by the force of gravity.

3. The track board system of claim 2 including a first additional track connected with said endless track.

4. The track board system of claim 3 herein said first additional track connects with said endless-loop track at both an entrance end and an exit end of said first additional track.

5. The track board system of claim 3 including a second additional track connected to said endless-loop track.

6. The track board system of claim 5 wherein said second additional track connects with said endless-loop track at both an entrance end and an exit end of said second additional track.

7. The track board system of claim 5 wherein said first additional track is a curved track and said second additional track is an S-shaped track.

8. The track board system of claim 2 wherein said track board has an outer margin and said track extends along at least a portion of said outer margin.

9. The track board system of claim 3 wherein said track extends in an oval.

10. The track board system of claim 3 wherein said track extends in a circle.

11. The track board system of claim 2 including structure for supporting a center area of said track board above ground and yet allowing peripheral areas of said track board to tilt downwardly and upwardly.

12. The track board system of claim 2 wherein said track has a depth of approximately 3⁄16 of an inch.

13. The track board system of claim 2 having a diameter of approximately 30 inches.

14. The track board system of claim 2 having a centrally located dome on the upper surface thereof and a cavity on the underside thereof extending upwardly into said dome.

15. The track board system of claim 14 comprising a base support including a base plate and a post extending upwardly from said base plate for being received in said cavity.

* * * * *